US005094641A

United States Patent [19]

McCleary et al.

[11] Patent Number: 5,094,641

[45] Date of Patent: Mar. 10, 1992

[54] APPARATUS AND METHOD FOR PROTECTING, INSTALLING AND REMOVING MERCURY-VAPOR LAMPS

[75] Inventors: Roger W. McCleary, Salem, N.H.; Robert S. Allegretto, Burlington, Mass.

[73] Assignee: General Signal Corporation, Stamford, Conn.

[21] Appl. No.: 561,540

[22] Filed: Aug. 1, 1990

[51] Int. Cl.[5] ..... H01K 3/32

[52] U.S. Cl. ..... 445/1; 29/428; 206/418

[58] Field of Search ..... 445/26, 29, 1, 58; 206/418; 427/67, 271, 356; 83/191, 875; 15/93.1, 220 A; 29/428

[56] References Cited

U.S. PATENT DOCUMENTS

| | | | |
|---|---|---|---|
| 506,531 | 10/1893 | McManus et al. | 29/428 |
| 1,710,543 | 4/1929 | Leo | 206/418 |
| 1,959,931 | 3/1934 | Schwartz | 206/418 |
| 2,637,232 | 5/1953 | McKean | 29/428 |
| 2,897,252 | 7/1959 | Martin | 206/418 |
| 3,884,560 | 5/1975 | Neylan et al. | 350/293 |
| 4,471,414 | 9/1984 | Savage, Jr. | 362/226 |
| 4,878,159 | 10/1989 | Blaisdell et al. | 362/222 |

FOREIGN PATENT DOCUMENTS

| | | | |
|---|---|---|---|
| 494563 | 3/1930 | Fed. Rep. of Germany | 206/418 |
| 507034 | 10/1930 | Fed. Rep. of Germany | 206/418 |

*Primary Examiner*—Kenneth J. Ramsey

*Attorney, Agent, or Firm*—Robert R. Hubbard; Harold Huberfeld

[57] ABSTRACT

An apparatus and method is provided for protecting, installing and removing a fragile device having a screw threaded mounting end. The apparatus includes a housing surrounding the fragile device having an open end with a screw threaded portion which is threaded in a direction opposite to the screw thread mounting end of the fragile device. An end ferrule is attached to the mounting end of the fragile device and has a screw thread portion adapted to threadingly engage the screw thread portion of the open end of the housing. The method is practiced by inserting the fragile device into the screw threaded open end of the housing and threadingly engaging the ferrule with the housing in a first direction to a desired level of torque. The screw threaded mount of the fragile device is then threadingly engaged in a screw threaded mounting hole by turning the housing in the same direction until the fragile device and the ferrule seats. The housing is then removed from the fragile device by continuing to turn the housing in the same direction until the housing is threadingly disengaged from the ferrule.

9 Claims, 4 Drawing Sheets

APPARATUS AND METHOD FOR PROTECTING, INSTALLING AND REMOVING MERCURY-VAPOR LAMPS

BACKGROUND OF THE INVENTION

The present invention relates generally to an apparatus and method for protecting, installing and removing a fragile device having a screw thread mount and more particularly to an apparatus and method for protecting, installing and removing mercury-vapor lamps to be used in lithography equipment utilized in the manufacture of electronic circuits and devices.

Step and repeat lithography equipment used in the manufacture of electronic circuits and devices require the use of a bright source of illumination for repeatedly exposing photoresist on a semiconductor wafer during the manufacturing process. Mercury-vapor lamps have been commonly used for this purpose. Typically such lamps have a screw thread mount for installing them in a particular piece of lithography equipment. Such mercury-vapor lamps are quite fragile and great care must be taken during shipment and installation to avoid the creation of even the smallest microscopic fractures in the lamp housing. Such fractures if undetected can lead to catastrophic failure of the lamp during operation. In addition, the glass housing of the lamp cannot be touched or contaminated by dirt during shipment or installation since fingerprints on the housing will reduce the transmission of light during operation which will negatively affect the performance of the lamp.

SUMMARY OF THE INVENTION

Accordingly, an apparatus and method is provided for protecting, installing and removing a fragile device having a screw threaded mounting end. The apparatus includes a housing surrounding the fragile device having an open end with a screw threaded portion which is threaded in a direction opposite to the screw thread mounting end of the fragile device. An end ferrule is attached to the mounting end of the fragile device and has a screw thread portion adapted to threadingly engage the screw thread portion of the open end of the housing. The method is practiced by inserting the fragile device into the screw threaded open end of the housing and threadingly engaging the ferrule with the housing in a first direction to a desired level of torque. The screw threaded mounting hole by turning the housing in the same direction until the fragile device and the ferrule seats. The housing is then removed from the fragile device by continuing to turn the housing in the same direction until the housing is threadingly disengaged from the ferrule.

OBJECTS OF THE INVENTION

Accordingly, an object of the present invention is the provision of an apparatus and method for installing and removing a fragile device in a screw thread mount without making physical contact with the fragile device.

Another object of the present invention is the provision of an apparatus and method for installing and removing a fragile device in and from a screw thread mount which is also useful for protecting the fragile device during shipment and disposal.

A further object of the present invention is the provision of such an apparatus and method which is particularly useful for shipping mercury-vapor lamps and for installing and removing mercury-vapor lamps in and from their screw thread mounts.

Yet another object of the present invention is the provision of an apparatus and method for protecting, installing and removing a mercury-vapor lamp which is both inexpensive to manufacture and easy to practice.

Other objects, advantages and novel features of the present invention will become apparent from the following detailed description of the invention when considered in conjunction with the accompanying drawings.

DESCRIPTION OF THE PREFERRED EMBODIMENT

Figure 1:
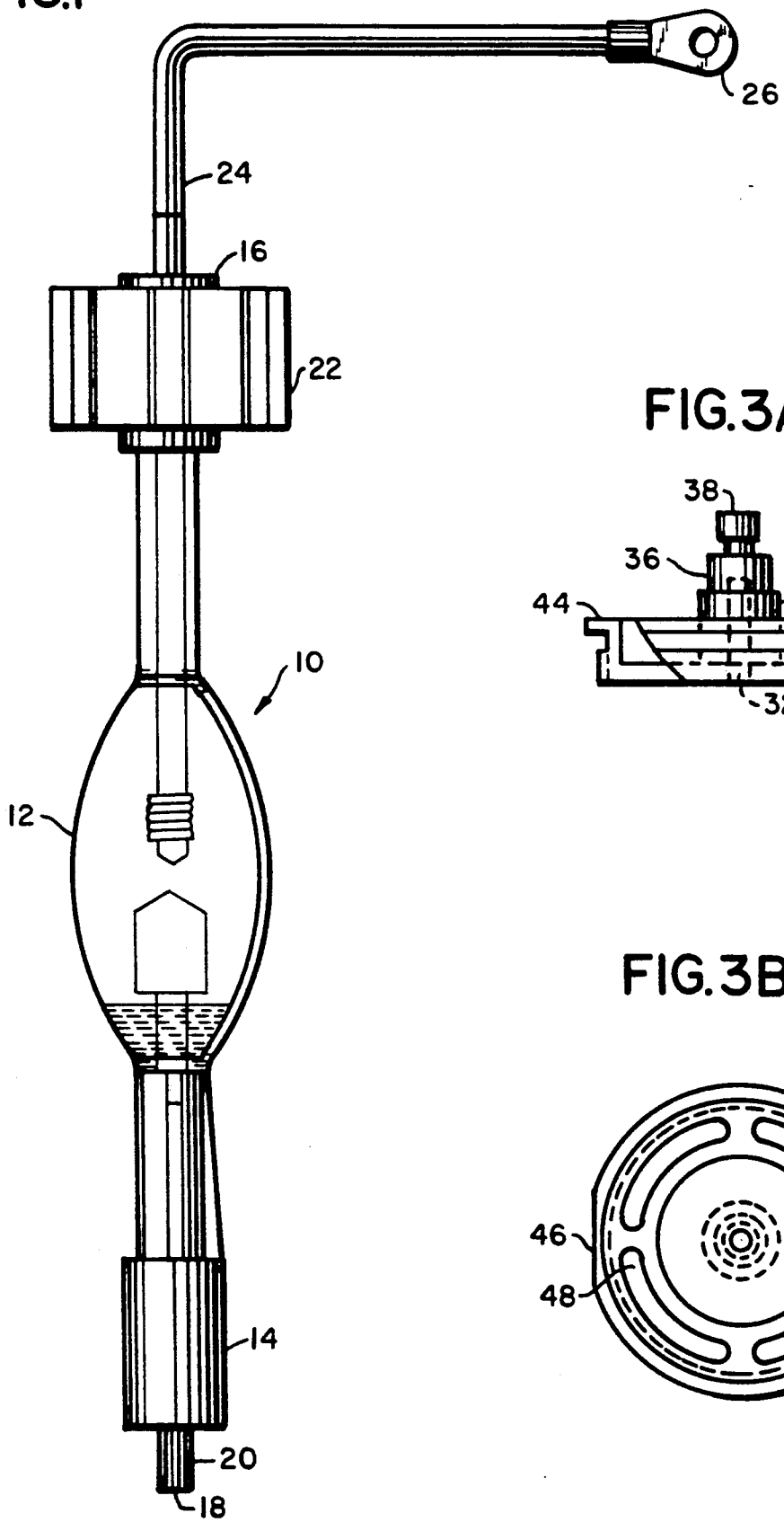
FIG. 1 shows a mercury-vapor lamp of a type that is known in the art and which is designed to be protected by the apparatus and method of the present invention.

FIG. 1 shows a mercury-vapor lamp of a type that is commercially available from USHIO AMERICA, Inc. Torrance, Calif. The lamp 10 includes a fragile glass housing 12 and a pair of terminals 14 and 16 at opposite ends. The terminal 14 has a stud 18 projecting therefrom having a right hand screw thread 20 contained on the surface thereof. The stud 18 is normally adapted to be threadingly engaged with a female right handed threaded mount in the illuminator compartment of a step and repeat lithography apparatus. However, as will become apparent from the description of the present invention, this is not the manner in which the stud 18 is used in conjunction with the present invention. The terminal 16 from the lamp 10 is surrounded by and in thermal contact with the heat-sink 22 for heat dissipating purposes. Also connected to the terminal 16 is a flexible electrical conducting cable 24 with a terminal connector 26 connected to the other end thereof.

Figure 3A:
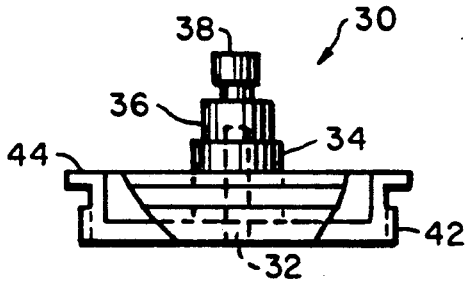
FIGS. 3A and 3B show a partial cutaway side view and an end view respectively of an end ferrule used in the apparatus and method of the present invention.
Figure 3B:
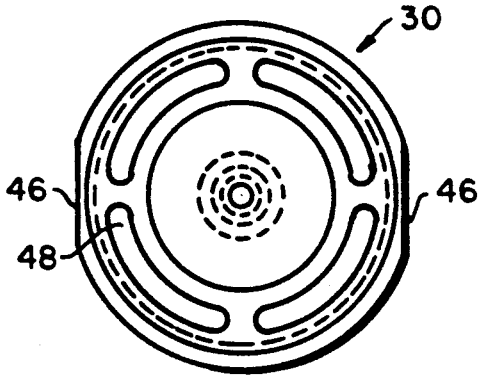
Figure 2:
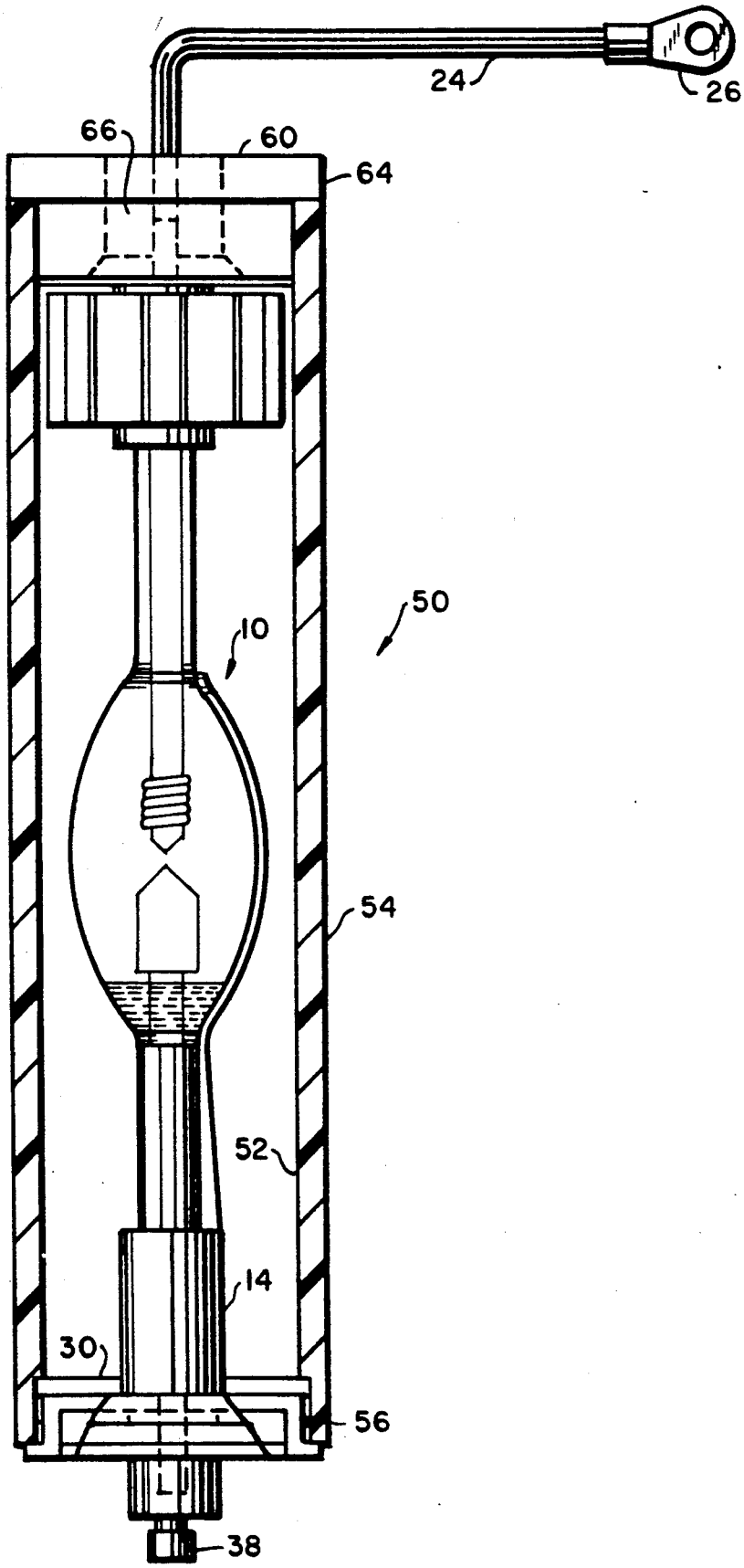
FIG. 2 shows a partial cross-section and cutaway view of the mercury-vapor lamp of FIG. 1 installed in the protective apparatus of the present invention.
Figure 4A:
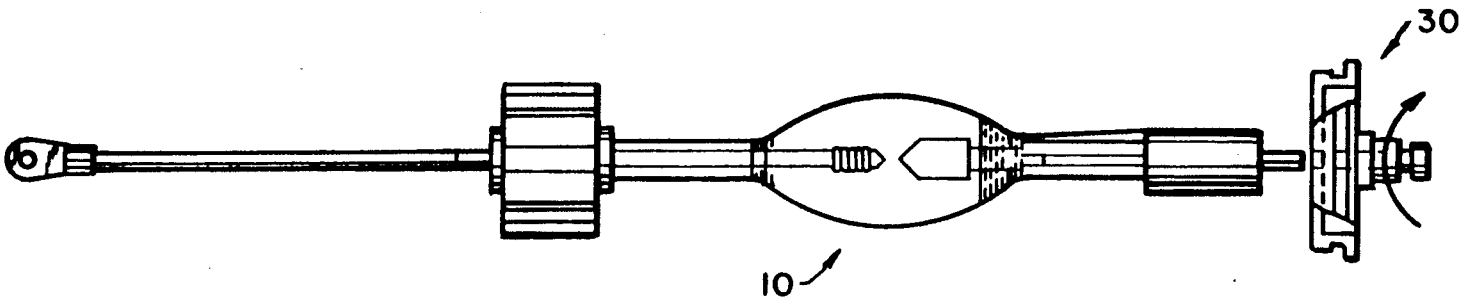
FIGS. 4A, 4B, 4C and 4D show partial cross-section and cutaway views of the components shown in FIGS. 1–3 to illustrate the method of the present invention.
Figure 4B:
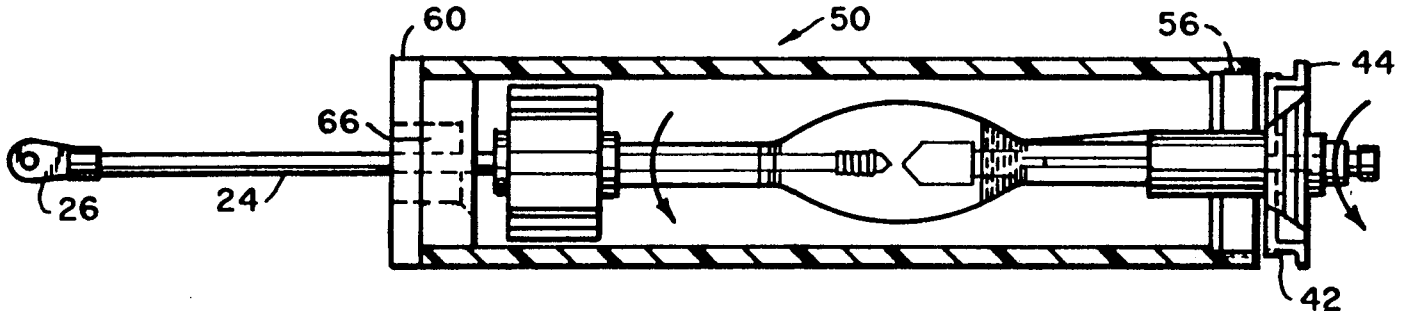
Figure 4C:
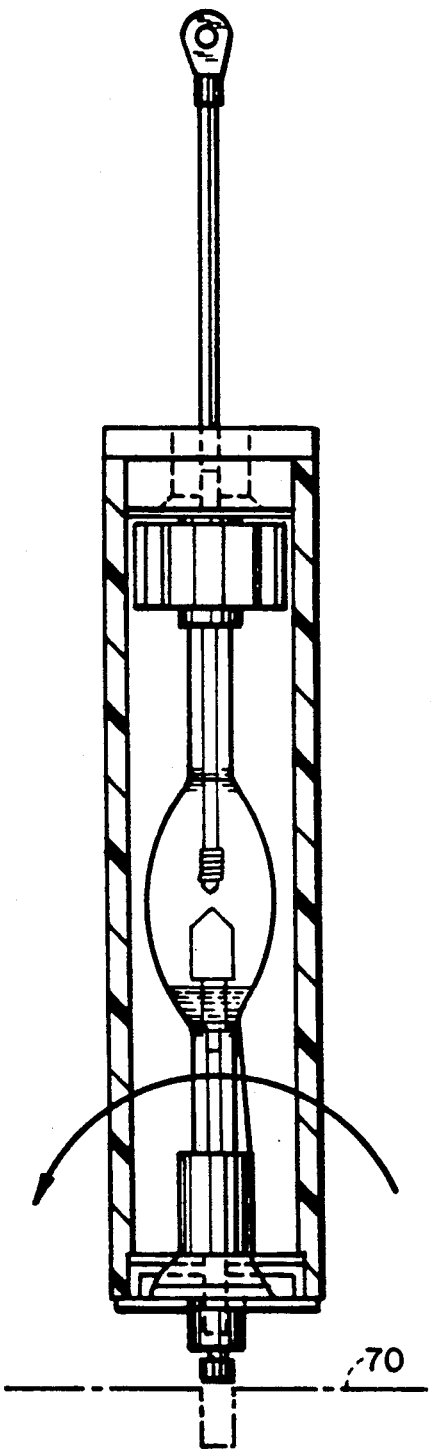
Figure 4D:
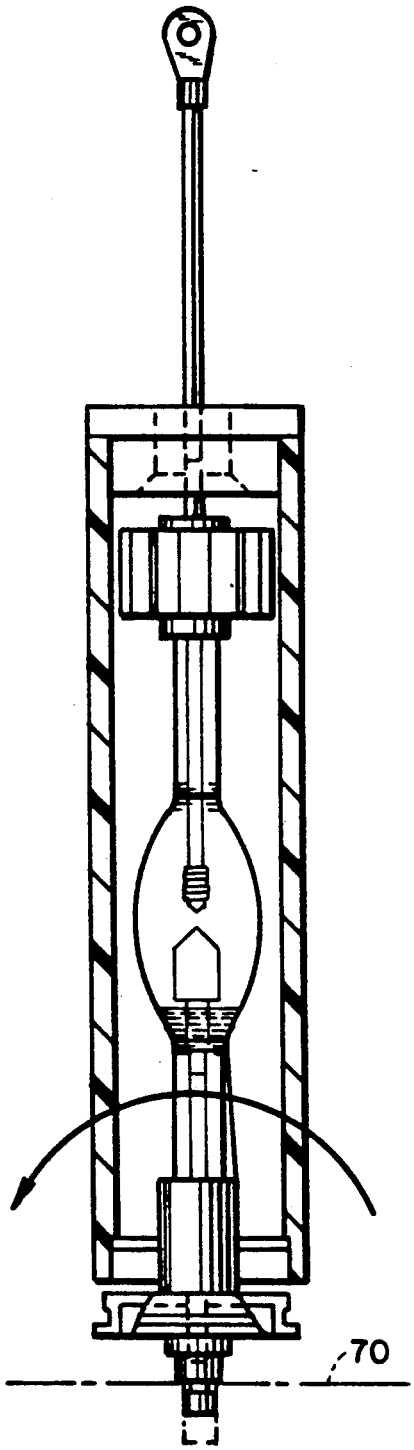

The apparatus of the present invention will now be described in connection with FIGS. 2 and 3. An end ferrule 30 is attached to the mounting end 14 of the mercury-vapor lamp 10. The end ferrule may be attached in any suitable manner. In this embodiment the end ferrule 30 includes a right handed threaded cavity 32 for threadingly engaging the threaded stud 18 on the lamp 10. The end ferrule 30 may also be integrally manufactured with the mounting end terminal 14 or in the alternative may be soldered or braised to the end terminal 14. The threaded cavity 32 is contained within inner stepped cylindrical projections 34 and 36 respectively. The threaded stud 38 projects outwardly from the cylindrical portion 36 and includes a right hand thread and is adapted to threadingly engage a female threaded mount within the illuminator of a step and repeat lithography apparatus (shown in phantom in FIGS. 4C and 4D). The end ferrule 30 further includes an outer cylindrical surface 40 having a left hand threaded portion 42 contained thereon. The cylindrical portion 40 terminates in a flange 44. The flange 44 preferably includes a pair of flat surfaces 46 to enable the engagement of a suitable torque applying wrench. The body of the end ferrule 30 preferably includes four arcuate vents 48 for permitting the circulation of air therethrough. The end ferrule 30 may be manufactured from any structurally strong material and in the preferred embodiment is made of nickel-plated copper.

A cylindrical sleeve 50 having an inner cylindrical surface 52 and an outer cylindrical surface 54 houses and surrounds the lamp 10. The sleeve 50 is open at both ends and includes a left hand screw threaded portion 56 at one end on the inner surface 52 adapted to threadingly engage the screw threaded portion 42 on end ferrule 30. While the screw threaded portions 42 and 56 have been described as being left handed, it is merely important that they be threaded in the direction opposite to that of the threaded portion 38. The inner diameter of the surface 52 is such that the lamp 10 including the heat-sink 22 clears the inner surface and is suspended within the sleeve 50 by the end ferrule 30. The flange 44 on end ferrule 30 seats against the open end of the cylindrical sleeve 50. The sleeve 50 is preferably made of a transparent acrylic plastic.

The other open end of the sleeve 50 is closed with a transparent acrylic plastic plug 60 having an inner cylindrical portion 62 with an outer surface which is adhered to the inner surface 52 of sleeve 50 preferably by an epoxy cement. Plug 60 further includes a flange 64 which seats against the other end of sleeve 50. The plug 60 further includes a clearance hole 66 to permit the passage of the cable 24 and terminal 26 therethrough.

In the method of the present invention, the screw threaded ferrule 30 is affixed to the end 14 of the lamp 10 at the point of manufacture of the lamp. In the case of the present embodiment this would be accomplished by threadingly engaging the stud 18 on lamp 10 with the cavity 32 in ferrule 30 in a clockwise direction. The terminal 26 and cable 24 are then fed through the hole 66 in plug 60 and the lamp 10 is carefully inserted into the sleeve 50. The threaded portion 56 of sleeve 50 is then threadingly engaged in the opposite or counterclockwise direction with threaded portion 42 of ferrule 30 until flange 44 seats against the end of sleeve 50 to the desired level of torque. The assembly is now suitable for shipment to the installation site. At the installation site, when it is desired to install the lamp 10 the threaded stud 38 of end ferrule 30 is threadingly engaged in a clockwise direction with a threaded mount (shown in phantom in FIGS. 4C and 4D) in the illuminator of a step and repeat apparatus. The entire apparatus including the threaded stud 38 is turned in a clockwise direction until the ferrule seats in its mount to a desired level of torque. During this process the stored torque in the left hand thread is transferred to the right hand thread. By continuing to turn the entire assembly in a clockwise direction, the sleeve 50 will threadingly disengage from the ferrule 30. Thus the housing 50 may be carefully removed by withdrawing it over the lamp 10 until the terminal 26 clears the housing.

In order to remove the lamp 10 from its illuminator mount after its period of service has been completed, the process is merely reversed. The sleeve 50 is carefully placed over the lamp 10 in its housing mount and the thread 56 is carefully engaged with the thread 44 in a counterclockwise direction until the end of sleeve 50 seats against the flange 44. The sleeve 50 is then continuously turned in a counterclockwise direction until torque is transferred to the ferrule 30 thereby disengaging the stud 38 from its mount. The entire assembly may then be safely discarded.

Thus it is clear that installation and removal process may be easily performed without touching the glass housing 12 and without stressing the lamp 10. Furthermore, the sleeve 50 serves to protect the lamp during shipment and disposal. The apparatus of the present invention is both inexpensive to manufacture and easy to use for protecting, installing, and removing mercury-vapor lamps or any screw mounted fragile device.

While there has been described what is at present considered to be the preferred embodiment of the present invention, it will be obvious to those skilled in the art that various changes and modifications may be made therein without departing from the invention, and it is, therefore, aimed in the appended claims to cover all such changes and modifications as fall in the true spirit and scope of the present invention.

What is claimed is:

1. An apparatus for protecting and installing a fragile device having a screw thread mounting end comprising:

a housing surrounding said fragile device, said housing being open at a first end and having a screw thread portion at said first open end, said screw thread portion being threaded in a direction opposite to said screw thread mounting end of said fragile device; and an end ferrule attached to said mounting end of said fragile device, said end ferrule having a screw thread portion adapted to threadingly engage said screw thread portion at said first open end of said housing.

2. An apparatus as set forth in claim 1 wherein said housing is a cylindrical sleeve having inner and outer cylindrical surfaces and wherein said fragile device is suspended within said cylindrical sleeve by said end ferrule.

3. An apparatus as set forth in claim 2 wherein said end ferrule includes a cylindrical portion containing said screw thread portion adapted to threadingly engage said screw thread portion on said cylindrical sleeve, said cylindrical portion terminating in a flange adapted to seat on said open end of said cylindrical sleeve.

4. An apparatus as set forth in claim 3 wherein said fragile device is a mercury-vapor lamp having a first end terminal to which said end ferrule is attached, and wherein said end ferrule further includes a plurality of vents for permitting the circulation of air therethrough.

5. An apparatus as set forth in claim 4, wherein said mercury-vapor lamp includes a second end terminal having an electrical cable attached thereto and extending outward therefrom, wherein said cylindrical sleeve has a second open end, and wherein said apparatus includes a plug cemented to said second open end, said plug having an opening therein for permitting the passage of said electrical cable therethrough.

6. A method of protecting and installing a fragile device having a screw thread mount and a screw threaded ferrule attached thereto, comprising:

inserting said fragile device into a screw threaded open end of a housing and threadingly engaging said ferrule with said housing to a desired level of torque;

threadingly engaging said screw thread mount of said fragile device in a screw threaded mounting hole by turning said housing in said first direction until said fragile device and said ferrule seat; and removing said housing from said fragile device by continuing to turn said housing in said first direction until said housing is threadingly disengaged from said ferrule.

7. A method as set forth in claim 6 wherein said fragile device is a mercury-vapor lamp.

8. A method as set forth in claim 7 further including the step of affixing said screw threaded ferrule to said screw thread mount.

9. A method as set forth in claim 6 further including a method for removing said fragile device from said mounting hole, comprising:

threadingly engaging said screw threaded open end of said housing by turning said housing in a second direction opposite to said first direction until said housing seats against said ferrule; and removing said fragile device from said mounting hole by continuing to turn said housing in said second direction thereby transferring torque to said ferrule to turn said ferrule in said second direction until said fragile device is threadingly disengaged from said mounting hole.

* * * * *